US005836522A

United States Patent [19]

Przystawik

[11] Patent Number: 5,836,522

[45] Date of Patent: Nov. 17, 1998

[54] WATER NOZZLE APPARATUS

[75] Inventor: Michael Gunter Przystawik, Cape Coral, Fla.

[73] Assignee: Waltzing Waters, Inc., Cape Coral, Fla.

[21] Appl. No.: 818,327

[22] Filed: Mar. 14, 1997

[51] Int. Cl.[6] ..... B05B 15/08

[52] U.S. Cl. ..... 239/588; 239/17

[58] Field of Search ..... 239/12, 16, 17, 239/19, 200, 201, 211, 229, 273, 279, 550, 587.1, 588, 589

[56] References Cited

U.S. PATENT DOCUMENTS

| | | | |
|---|---|---|---|
| 150,742 | 5/1874 | Barry et al. | 239/273 X |
| 623,057 | 4/1899 | Wentz | 239/446 X |
| 667,913 | 2/1901 | Kirk | 239/273 X |
| 691,419 | 1/1902 | Vandervoort | 239/273 X |
| 1,296,045 | 3/1919 | Campbell | 239/588 X |
| 2,023,984 | 9/1935 | Wells, Jr. | 239/589 |
| 2,203,210 | 6/1940 | Young | 239/588 |
| 3,092,329 | 6/1963 | Twaroch | 239/229 X |
| 3,228,613 | 1/1966 | Goldstein | 239/588 X |
| 3,503,544 | 3/1970 | Clifton | 239/550 X |
| 4,961,535 | 10/1990 | Skibik | 239/279 X |
| 5,156,339 | 10/1992 | Gibson et al. | 239/289 |

*Primary Examiner*—Andres Kashnikow
*Assistant Examiner*—Steven J. Ganey
*Attorney, Agent, or Firm*—William E. Noonan

[57] ABSTRACT

An adjustable water nozzle apparatus is disclosed including a generally tubular first conduit portion that is communicably interengaged with the water supply line. A generally tubular second conduit portion has a discharge outlet. A generally tubular, longitudinally flexible bellows portion communicably interconnects the first and second conduit portions. The bellows portion is longitudinally flexed to angularly adjust the second conduit portion relative to the first conduit portion. The bellows portion is sufficiently rigid to hold the second conduit portion in an angularly selected orientation relative to the first conduit portion such that water is directed through the nozzle apparatus and discharged from the outlet in a selected direction.

9 Claims, 2 Drawing Sheets

WATER NOZZLE APPARATUS

FIELD OF THE INVENTION

This invention relates to a water nozzle apparatus and, more particularly, to an adjustable water nozzle having a swaged nozzle tip for use in musical water fountains and other types of ornamental water fountain displays.

BACKGROUND OF THE INVENTION

Ornamental water fountain displays are exhibited in a wide variety of settings. Relatively modest fountains may be found outside of residences and commercial establishments. Much more elaborate and spectacular fountains are commonly featured as attractions at amusement and theme parks throughout the world. Musical water fountains are particularly popular.

Musical fountain exhibits are typically arranged to provide unique, colorful and extravagant displays. Elaborate effects are achieved by directing streams of water at various angles, coloring the streams with appropriate lighting and setting the entire display to accompanying music. Conventional fountains employ multiple nozzles that are capable of projecting the water in long and attractive streams. Each display typically requires its own configuration of fountain streams. To achieve this effect, the fountain nozzles should be individually adjustable. Specifically, each nozzle should be capable of being independently adjusted and angularly pointed to direct the spray in a selected direction.

To date, only limited and usually unsatisfactory nozzle adjustments are permitted. Most musical fountains utilize a conventional ball valve that swivels in a valve seat to direct the water stream in a desired direction. These fountain nozzles typically cannot be adjusted to point more than 15 degrees from vertical. Angularly adjusting the nozzle to a greater degree tends to create excessive turbulence in the water stream. As a result, a distorted or otherwise unattractive stream is produced. Additionally, because the ball valve and seat are separate components, they exhibit an expansion differential, which can also interfere with the fountain spray.

Instead of using a swivelable ball valve, an adjustable water fountain nozzle can employ a flexible lead pipe. Such material is usually fairly easy to bend and will retain its flexed configuration even as water passes through the nozzle. However, a lead pipe nozzle is not acceptable for adjustments of 45 degrees or more. If the pipe is bent beyond that angle, it is apt to break when the operator attempts to return it to a vertical configuration.

SUMMARY OF INVENTION

It is therefore an object of this invention to provide a water fountain nozzle that may be quickly and conveniently adjusted to direct a water fountain stream in a desired direction.

It is a further object of this invention to provide an adjustable water fountain nozzle that permits a water fountain stream to be conveniently directed in a wide variety of angularly selected directions.

It is a further object of this invention to provide an adjustable water fountain nozzle that is bendable to a much greater degree than standard nozzles.

It is a further object of this invention to provide an adjustable water fountain nozzle that is particularly suitable for use with musical fountains and other types of ornamental water fountains.

It is a further object of this invention to provide a water fountain nozzle, which significantly reduces turbulence and produces a long, attractive water stream.

It is a further object of this invention to provide an adjustable water fountain nozzle that is quick, convenient and reliable to adjust, even after being bent 45 degrees or more relative to vertical.

It is a further object of this invention to provide an adjustable water fountain nozzle that employs a simple and easy to manufacture one-piece construction.

It is a further object of this invention to provide an adjustable water fountain nozzle that operates reliably over long periods of time without requiring frequent repair or replacement.

It is a further object of this invention to provide an adjustable water fountain nozzle that produces attractive water fountain displays for a wide variety of settings and applications.

This invention results from a realization that a water fountain nozzle may be quickly, conveniently and reliably adjusted to direct the water stream in a selected direction by employing a longitudinally flexible bellows portion for delivering the water to a discharge opening of the nozzle. Such a construction permits the nozzle to be manufactured in one piece, as opposed to the multiple-piece ball valves used in the prior art. Additionally, this construction significantly reduces the turbulence exhibited by ball valve nozzles particularly at angles greater than 15 degrees from vertical.

This invention relates to an adjustable water nozzle apparatus including a generally tubular first conduit portion communicably interengaged with the water supply line. There is a generally tubular second conduit portion having a discharge outlet. A generally tubular, longitudinally flexible bellows portion communicably interconnects the first and second conduit portions. The bellows portion is flexed to angularly adjust the second conduit portion relative to the first conduit portion. The bellows portion is sufficiently rigid to hold the second conduit portion in an angularly selected orientation relative to the first conduit portion such that water is directed through the nozzle apparatus and discharged from the outlet in a selected direction.

In a preferred embodiment, the first and second conduit portions and the bellows portion have respective, axially alignable central channels. The bellows portion may include a longitudinal series of circumferential ribs. The ribs are preferably spaced longitudinally to permit the second conduit portion to be flexed up to approximately 45 degrees relative to the first conduit portion. A force of at least 205 inch lbs. may be required to flex the intermediate portion.

The second conduit portion may include a relatively wide diameter connector section that is attached and located immediately adjacent to the bellows portion. A relatively narrow diameter tip section is located at the distal end of the second conduit portion and includes the outlet. A tapered transitional section may interconnect the connector section and the tip section. The connector section, the tip section and the transitional section preferably comprise a single unitary piece. The connector and tip sections may include respective conduit walls. The wall of the tip section may be thicker than the wall of the connector section. The transitional section may include a truncated conical shape. Normally the second conduit portion is swaged to provide this shape.

A method of manufacturing an adjustable water nozzle is also disclosed. Initially, a generally tubular conduit having a uniform diameter is manufactured. A generally tubular, longitudinally flexible bellows portion is formed by hydroforming or other means in a wall of the conduit and between the ends of the conduit. This bellows portion separates the first portion of the conduit from the second portion of the conduit. The second conduit portion is swaged and the outlet discharge may be widened to a selected diameter.

BRIEF DESCRIPTION OF THE DRAWINGS

Other objects, features and advantages will occur from the following description of preferred embodiments and the accompanying drawings, in which.

DETAILED DESCRIPTION OF PREFERRED EMBODIMENTS

Figure 1:
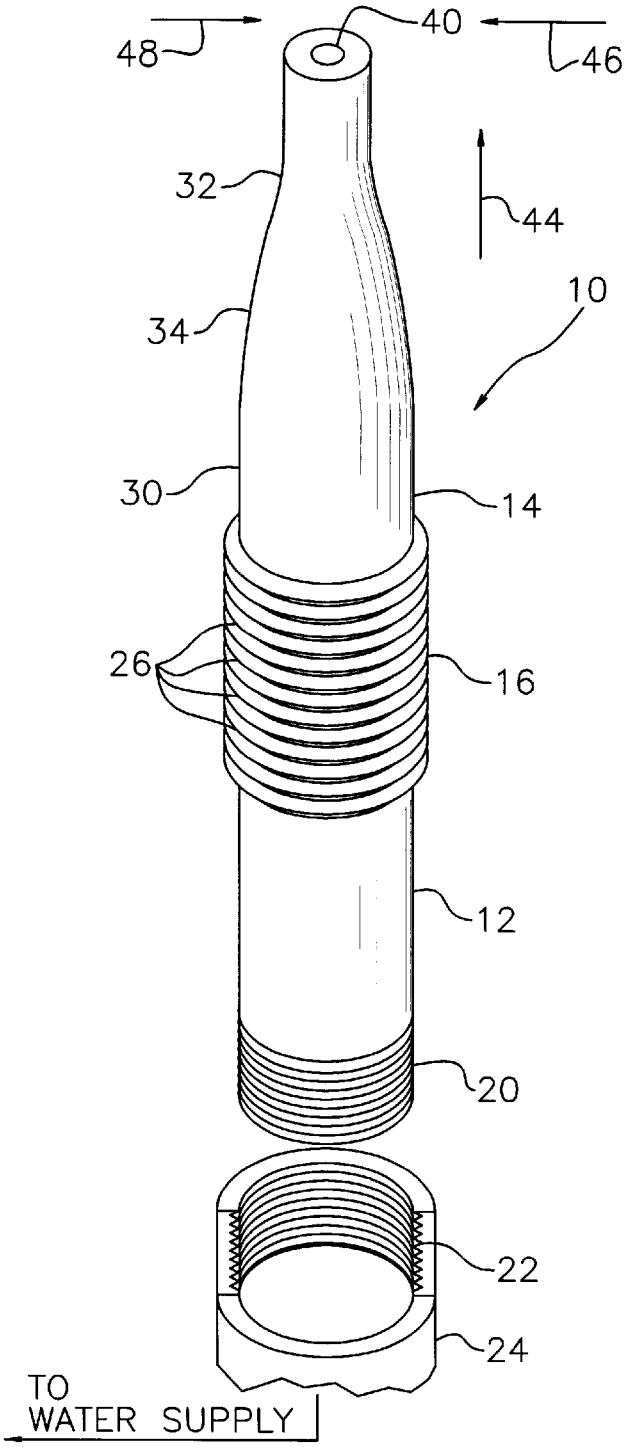
FIG. 1 is a perspective, partly cut away and partly schematic view of a preferred adjustable water nozzle according to this invention.

There is shown in FIG. 1 an adjustable nozzle 10 for a water fountain. Nozzle 10 is suitable for use with all varieties of water fountains and is particularly effective for use in ornamental water displays and musical fountains of the type employed at amusement parks, theme parks and similar types of attractions. Nozzle 10 includes generally tubular first and second conduit portions 12 and 14, respectively, which are communicably interconnected by a generally tubular bellows portion 16. Tubular portions 12, 14, and 16 are unitarily interconnected and comprise a one-piece construction. The nozzle is preferably composed of a durable metal or metal alloy such as stainless steel or Monnel®. Various synthetic plastics may also be utilized.

Figure 2:
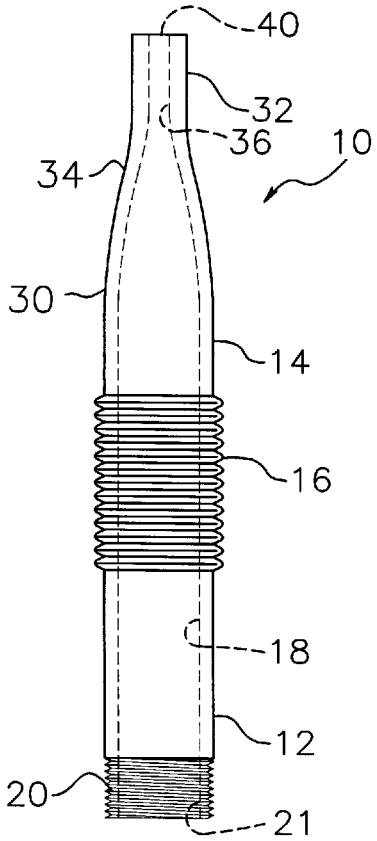
FIG. 2 is an elevational view of the nozzle with the interior nozzle channel shown in phantom.

As best shown in FIG. 2, nozzle 10 includes a central passageway or channel 18 that extends fully through sections 12, 14 and 16. First conduit portion 12 carries an annular threaded component 20. A central opening 21 extends through threaded portion 20 and communicates with the central channel 18 of apparatus 10. As best illustrated in FIG. 1, the threaded component is selectively interengaged with a complementary threaded fixture 22 of tubular water line 24. A conventional pressurized water supply is interconnected with water line 24 and selectively delivers water through the water line to nozzle 10, in a known manner, when the nozzle is interengaged with the water line. This permits the water to be sprayed by nozzle 10 in a fluid stream, as will be described more fully below.

Conduit portion 12 has a uniform diameter for the entire length of that portion. Bellows portion 16 comprises a plurality of circumferential ribs 26 that are arranged longitudinally along portion 16. The bellows portion is preferably manufactured by hydroforming or another fluid-shaping process. Portion 16 is longitudinally flexible so that nozzle 10 may be angularly adjusted in accordance with this invention. Such adjustment is described more fully below. As best shown in FIG. 2, when bellows portion 16 is in a longitudinally straight condition, channel 18 is axially aligned through both portion 12 and portion 16.

Second conduit portion 14 includes a relatively wide connector segment 30 that is located adjacent to bellows portion 16 and a relatively narrow diameter tip segment 32 that is located at the distal end of the second conduit portion. Segments 30 and 32 are interconnected by a tapered transitional segment 34. As previously indicated, segments 30, 32 and 34 preferably feature a unitary, one-piece construction. As best illustrated in FIG. 2, channel 12 gradually narrows within tapered portion 34. A restricted channel portion 36 is formed within tip segment 32. Restricted portion 36 exits tip segment 32 through a cylindrical discharge outlet 40, FIGS. 1 and 2, which is formed in the distal end of conduit portion 14.

Nozzle 10 is manufactured by first constructing or obtaining a one-piece, cylindrical component. Bellows portion 16 is then formed between the ends of the tubular component by an appropriate process such as hydroforming. Conduit portion 14 is swaged, machined or otherwise shaped such that segment 30 retains a diameter that is identical or very close to the diameter of conduit portion 12, tip segment 32 has a greatly reduced diameter and transitional segment 34 has a generally truncated conical shape, with a diameter that reduces from that of segment 30 to that of segment 32. Conduit portion 14 may be swaged by longitudinally pulling that portion as indicated by arrow 44 in FIG. 1 and diametrically compressing portion 14 as indicated by arrows 46 and 48 in FIG. 1. As a result, the tubular wall of tip segment 32 is significantly thicker than the tubular wall of connector segment 30. Likewise, restricted portion 36 of channel 12 is significantly narrower than the remainder of the channel. See FIG. 2. After swaging is completed, channel portion 36 and discharge outlet 40 may be machined to a desired diameter. This diameter should be selected to achieve the type of water stream required of the fountain.

Figure 3:
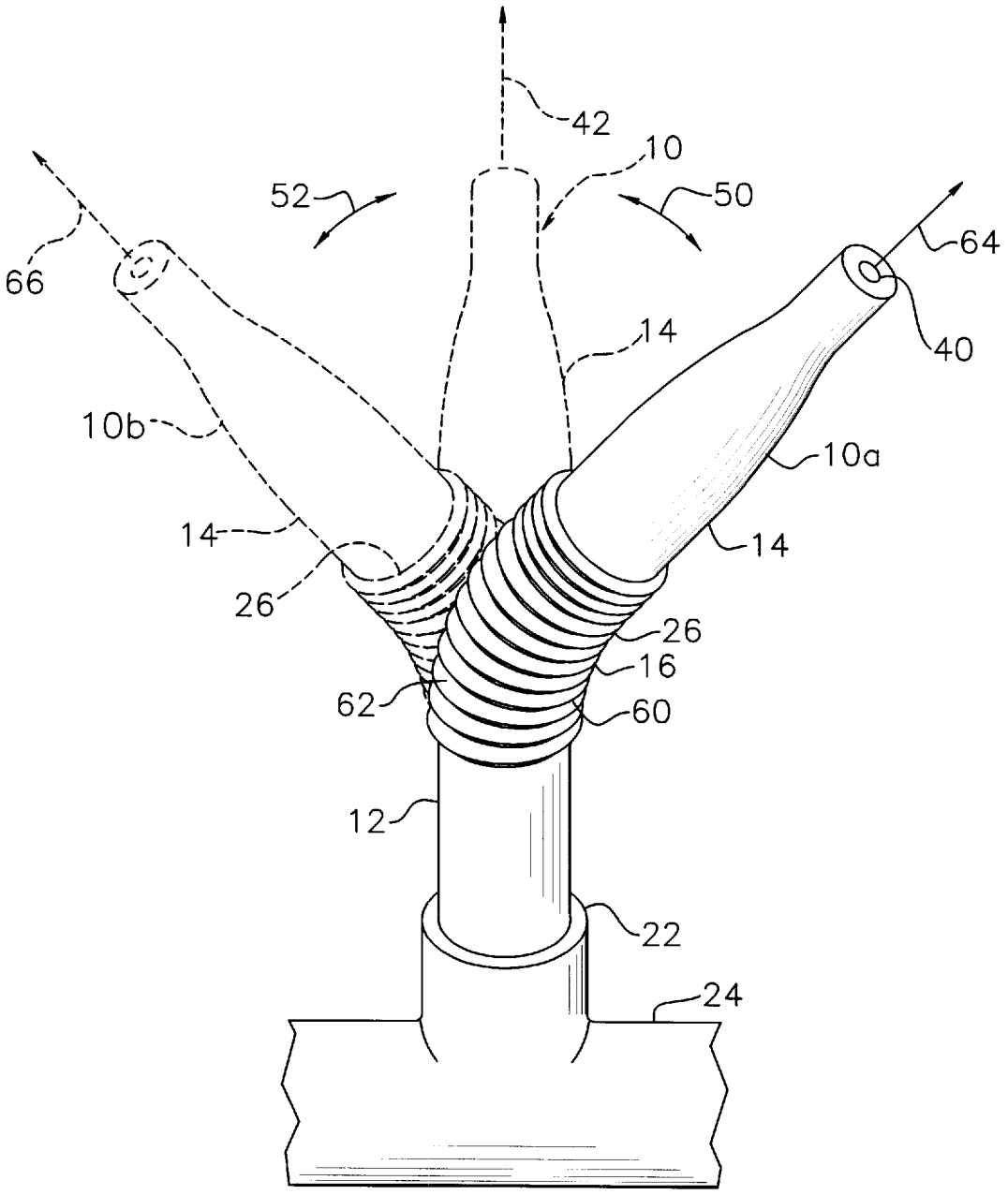
FIG. 3 is a perspective view of the nozzle in various angularly adjusted positions for directing water in respective selected directions.

Bellows portion 16 is longitudinally flexed to angularly adjust nozzle 10 in the manner shown in FIG. 3. The bellows portion is manufactured to provide a desired degree of flexibility. Specifically, the material forming bellows portion 16 and the number and spacing of ribs 26 are chosen so that nozzle 10 is easily flexed but is still capable of maintaining flexed shape and its adjusted position while water is being directed through the nozzle. In the vertical orientation shown by nozzle 10 in FIGS. 1 and 2 (and in phantom in FIG. 3) portions 12, 14 and 16 are axially aligned and channel 18 is essentially straight. As a result, water is directed through line 24, fixture 22 and nozzle 10 and discharged from outlet 40 in the vertical direction of arrow 42, shown in phantom in FIG. 3.

To angularly adjust the direction of the water stream, nozzle 10 is flexed in the manner indicated by double-headed arrows 50 and 52. In practice, such flexing may be accomplished over a 360 degree range of motion. With nozzle 10 attached to water line 24 and fixture 22, the fountain operator grasps conduit portion 14, either by hand or by an appropriate tool, such as pliers or a wrench. Conduit portion 14 is manipulated to point the nozzle discharge outlet 40 in a desired direction. More particularly, nozzle 10 is flexed along bellows portion 16 so that the axes of conduit portions 12 and 14 are angularly adjusted. Bellows 16 is constructed to exhibit an appropriate degree of both flexibility and rigidity. Specifically, the bellows portion should be sufficiently flexible so that it is quick and easy to angularly adjust conduit portion 14 relative to conduit portion 12. At the same time, the bellows portion should be sufficiently rigid so that nozzle 10 maintains its angularly adjusted position while water is directed under pressure through the nozzle. In a preferred embodiment, a force of at least 205 inch lbs. is required to flex the bellows portion. This force requirement ensures that the bellows portion has the required rigidity. The proper mixture of rigidity and flexibility are obtained by properly selecting the material of bellows portion 16 as well as the number and spacing of the circumferential ribs 26 in the bellows portion.

As shown in FIG. 3, when the nozzle is flexed and adjusted, for example into the position indicated by nozzle 10*a*, bellows portion 16 is bent such that on one side 60 of the bellows portion, longitudinal ribs 26 are compressed and on the opposite side 62, the ribs are spread apart. The ribs are configured and spaced apart in an opposite fashion when the nozzle is flexed forward in the opposite direction, indicated by nozzle 10*b*.

It is quite important that the bellows portion 16 permit conduit portion 14 to be flexed approximately 45 degrees relative to conduit portion 12. This means that the respective conduit portions 12 and 14 can be axially arranged at about a 45 degree angle. This angle is depicted by each of the flexed nozzles 10*a* and 10*b* in FIG. 3 and represents a significant improvement over conventional fountain nozzles, which are limited to an effective adjustment angle of approximately 15 degrees from vertical. With the nozzle in an angularly adjusted position, water is directed through the bent channel 18 and discharged from outlet 40 as indicated, for example, by arrows 64 and 66. Attractive water streams are thereby produced and turbulence is minimized. As a result, a much more effective and attractive fountain display is achieved. At the same time, the flexed nozzles, indicated by nozzles 10*a* and 10*b*, are easy to readjust, either to the vertical orientation indicated by nozzle 10 or to various other angularly adjusted positions.

In operation, nozzle 10 is manufactured in the previously described manner. The nozzle is then threadably interengaged with water line 24 by screwing threaded depending portion 20 into fixture 22. Bellows portion 16 is then flexed to angularly adjust conduit portion 14 a desired extent relative to conduit portion 12. In a typical fountain display, an arbitrary number of fixtures 22 and nozzles 10 are employed. In some displays, all of the nozzles are adjusted in a similar manner. In other displays, the nozzles are individually adjusted to varying angles. After completion of the angular nozzle adjustment, the fountain is ready for use. Pressurized water is delivered to each of the nozzles and the nozzles produce water streams in the selected direction or directions. Subsequently, the angles of each nozzle may be individually adjusted as required. It is also a fairly simple and quick procedure to repair and/or replace the nozzle when required.

It should be noted that in other preferred embodiments, nozzle 10 may be manufactured in an alternative manner. For example, conduit portions 12 and 14 and bellows portion 16 may comprise two or more separate parts that are screwed or welded together or otherwise communicably joined. The unitary, single-piece construction is particularly preferred, however, because it eliminates the complexity and expense of standard multiple-part nozzles. Additionally, the unitary bellows portion provides greatly improved angular adjustment capability and significantly reduces water fountain turbulence.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. In a water display fountain, which fountain includes a pressurized water supply and a water supply line connected to the water supply, the improvement consisting of an adjustable water nozzle apparatus, said apparatus comprising:

a cylindrically tubular, unthreaded first conduit portion communicably interengaged with the water supply line;

a generally tubular second conduit portion having a discharge outlet; and a generally tubular, longitudinally flexible bellows portion that communicably interconnects said first and second conduit portions, said bellows portion including a selected material and a longitudinal series of circumferential ribs, which ribs are of a selected number and spacing, such that a force of at least 205 inch pounds is required to flex said bellows portion and angularly adjust said second conduit portion relative to said first conduit portion, said bellows portion being sufficiently rigid to hold said second conduit portion in an angularly selected orientation relative to said first conduit portion such that water is directed through said nozzle apparatus and discharged from said outlet in a selected direction;

said second conduit portion including a relatively wide diameter cylindrical connector segment that is attached and located immediately adjacent to said bellows portion, a relatively narrow diameter cylindrical tip segment that includes a distal end of said second conduit portion and said discharge outlet, and a tapered transitional segment that interconnects said connector segment and said tip segment;

said first and second conduit portions and said bellows portion comprising a single unitary piece.

2. The apparatus of claim 1 in which said first and second conduit portions and said bellows portion have respective, axially alignable central channels.

3. The apparatus of claim 1 in which said ribs are longitudinally spaced to permit said second conduit portion to flex to approximately 45 degrees relative to said first conduit portion.

4. The apparatus of claim 1 in which said connector and said tip segments include respective conduit walls, said wall of said tip segment being thicker than said wall of said connector segment.

5. The apparatus of claim 1 in which said transitional segment includes a truncated conical shape.

6. The apparatus of claim 1 in which said second conduit portion includes a swaged construction.

7. A water display fountain comprising:

a pressurized water supply;

a water supply line connected to said water supply, said water supply line including a plurality of threaded outlet fixtures, and a plurality of adjustable water nozzle apparatuses, each apparatus including a generally tubular first conduit portion, an annular threaded component attached to said first conduit portion and releasably interengagable with a selected one of said threaded fixtures, a generally tubular second conduit portion having a discharge outlet, and a generally tubular, longitudinally flexible bellows portion that communicably interconnects said first and second conduit portions, said bellows portion including a selected material and a longitudinal series of circumferential ribs, which ribs are of a selected number and spacing, such that a force of at least 205 inch pounds is required to flex said bellows portion and angularly adjust said second conduit portion relative to said first conduit portion, said bellows portion being sufficiently rigid to hold said second conduit portion in an angularly selected orientation relative to said first conduit portion such that water is directed through said nozzle apparatus and discharged from said outlet in a selected direction;

said second conduit portion including a relatively wide diameter cylindrical connector segment that is attached and located immediately adjacent to said bellows portion, a relatively narrow diameter cylindrical tip segment that includes a distal end of said second conduit portion and said discharge outlet, and a tapered transitional segment that interconnects said connector segment and said tip segment;

said first and second conduit portions and said bellows portion comprising a single unitary piece.

8. The fountain display of claim 7 in which said connector segment and said tip segment include respective conduit walls, said wall of said tip segment being thicker than said wall of said connector segment.

9. The fountain display of claim 7 in which said second conduit portion includes a swaged construction.

* * * * *